US010497327B2

(12) United States Patent
Choo et al.

(10) Patent No.: US 10,497,327 B2
(45) Date of Patent: Dec. 3, 2019

(54) DISPLAY APPARATUS AND METHOD OF DRIVING THE SAME

(71) Applicant: SAMSUNG DISPLAY CO., LTD., Yongin, Gyeonggi-Do (KR)

(72) Inventors: Jong-Won Choo, Seongnam-si (KR); Hyoung-Rae Lee, Asan-si (KR); Moon-Ju Kim, Asan-si (KR); Eun-Suk Kim, Asan-si (KR); Seok-Kun Yoon, Yongin-si (KR); Kwang-Youl Lee, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/789,926

(22) Filed: Jul. 1, 2015

(65) Prior Publication Data

US 2016/0203776 A1 Jul. 14, 2016

(30) Foreign Application Priority Data

Jan. 9, 2015 (KR) ..... 10-2015-0003558

(51) Int. Cl.
*G09G 3/36* (2006.01)

(52) U.S. Cl.
CPC ..... *G09G 3/3607* (2013.01); *G09G 3/3648* (2013.01); *G09G 3/3614* (2013.01); *G09G 2300/0426* (2013.01); *G09G 2300/0465* (2013.01); *G09G 2310/0297* (2013.01); *G09G 2320/028* (2013.01); *G09G 2320/0271* (2013.01)

(58) Field of Classification Search
None
See application file for complete search history.

(56) References Cited

U.S. PATENT DOCUMENTS 6,577,371 B2 6/2003 Hirabayashi
8,068,085 B2 * 11/2011 Yamazaki ..... G02F 1/136213 345/100
8,164,267 B2 4/2012 Matsueda et al.
8,520,035 B2 * 8/2013 Lee ..... G09G 3/3648 345/690

(Continued)

FOREIGN PATENT DOCUMENTS

CN 1202635 A 12/1998
CN 1497513 A 5/2004

(Continued)

*Primary Examiner* — Parul H Gupta
(74) *Attorney, Agent, or Firm* — Lewis Roca Rothgerber Christie LLP

(57) ABSTRACT

A display apparatus including a display region including a first high pixel connected to a first gate line and a first data line, and a first low pixel connected to the first gate line and a second data line, the first high pixel being configured to represent a first high grayscale level, the first low pixel being configured to represent a first low grayscale level, a gate driver configured to apply a gate signal to the gate line, a data driver including a first output part configured to apply a data voltage to the first data line and the second data line, and a selecting part configured to alternately connect the first data line and the second data line to the first output part of the data driver.

19 Claims, 7 Drawing Sheets

(56) References Cited

U.S. PATENT DOCUMENTS

| | | | | |
|---|---|---|---|---|
| 2004/0239696 | A1* | 12/2004 | Okabe | G09G 3/325 345/690 |
| 2006/0092113 | A1 | 5/2006 | Nitta et al. | |
| 2006/0192744 | A1 | 8/2006 | Yamazaki | |
| 2011/0205260 | A1* | 8/2011 | Weng | G09G 3/3648 345/691 |
| 2011/0310080 | A1 | 12/2011 | Tonomura | |
| 2012/0218316 | A1 | 8/2012 | Wang et al. | |
| 2013/0235006 | A1* | 9/2013 | Shin | G09G 3/003 345/204 |
| 2014/0104248 | A1* | 4/2014 | Won | G09G 5/00 345/204 |
| 2014/0152629 | A1 | 6/2014 | So et al. | |
| 2017/0316748 | A1* | 11/2017 | Shim | G09G 3/3607 |

FOREIGN PATENT DOCUMENTS

| | | | |
|---|---|---|---|
| CN | 101364387 | A | 2/2009 |
| EP | 0 942 315 | A2 | 9/1999 |
| JP | 2003-114657 | A | 4/2003 |
| KR | 10-2006-0083645 | A | 7/2006 |
| KR | 10-2012-0057214 | A | 6/2012 |
| TW | 200305128 | A | 10/2003 |

* cited by examiner

DISPLAY APPARATUS AND METHOD OF DRIVING THE SAME

CROSS-REFERENCE TO RELATED APPLICATION

This application claims priority to and the benefit of Korean Patent Application No. 10-2015-0003558, filed on Jan. 9, 2015 in the Korean Intellectual Property Office KIPO, the content of which is herein incorporated by reference in its entirety.

BACKGROUND

1. Field

Aspects of exemplary embodiments of the present inventive concept relate to a display apparatus and a method of driving the display apparatus.

2. Description of the Related Art

A liquid crystal display ("LCD") apparatus includes a first substrate including a pixel electrode, a second substrate including a common electrode and a liquid crystal layer located between the first and second substrate. An electric field is generated by voltages applied to the pixel electrode and the common electrode. By adjusting an intensity of the electric field, a transmittance of a light passing through the liquid crystal layer may be adjusted so that a desired image may be displayed.

To adjust the electric filed of the liquid crystal layer, the display apparatus includes an integrated circuit part applying a gate signal and a data voltage. As a resolution of the display apparatus increases, the number of the gate lines and the data lines increases, a space to mount the elements of a display panel driver may decrease and the power consumption of the display panel driver may increase.

Various kinds of liquid crystal modes have been developed to improve a side visibility of a display panel. For example, in a vertical alignment mode, a unit pixel is divided into a plurality of subpixels. Different electric fields are applied to respective subpixels for the same grayscale level. For example, the subpixels may be a high pixel or a low pixel.

A first buffer of a data driver may apply a high grayscale data having a relatively high grayscale level for a specific grayscale to the high pixel through a first data line and a first transistor. A second buffer of the data driver may apply a low grayscale data having a relatively low grayscale level for the specific grayscale to the low pixel through a second data line and a second transistor. The above explained structure may be referred to as a transistor-transistor ("TT") structure.

In the TT structure, the data driver may utilize channels twice the size (e.g., twice the length) of channels of a related art data driver and may utilize twice the number of driver ICs of the related art data driver. Thus, the number of the data integrated circuits, the complexity of the driving circuit and the manufacturing cost of the display apparatus may dramatically increase.

The above information disclosed in this Background section is only for enhancement of understanding of the background of the invention and therefore it may contain information that does not form the prior art that is already known to a person of ordinary skill in the art

SUMMARY

Aspects of exemplary embodiments of the present inventive concept are directed toward a display apparatus for improving a side visibility and reducing the number of the data integrated circuits, the complexity of the driving circuit and the manufacturing cost.

Aspects of exemplary embodiments of the present inventive concept are also directed toward a method of driving the display apparatus.

According to an exemplary embodiment of the present invention, there is provided a display apparatus including: a display region including a first high pixel connected to a first gate line and a first data line, and a first low pixel connected to the first gate line and a second data line, the first high pixel being configured to represent a first high grayscale level, the first low pixel being configured to represent a first low grayscale level; a gate driver configured to apply a gate signal to the gate line; a data driver including a first output part configured to apply a data voltage to the first data line and the second data line; and a selecting part configured to alternately connect the first data line and the second data line to the first output part of the data driver.

In an embodiment, the selecting part includes: a first switch to connect the first data line to the first output part; and a second switch to connect the second data line to the first output part.

In an embodiment, the first switch is turned on in response to a high duration of a first switching signal, the second switch is turned on in response to a high duration of a second switching signal, and when a high duration of the gate signal is 1H, the high duration of the first switching signal is equal to or less than ½H and the high duration of the second switching signal is equal to or less than ½H.

In an embodiment, the selecting part is between the data driver and the display region.

In an embodiment, the selecting part is on a peripheral region, the peripheral region being for not displaying an image in a display panel.

In an embodiment, the selecting part further includes: a first switching line configured to apply the first switching signal to the first switch; and a second switching line configured to apply the second switching signal to the second switch, wherein the first switching line and the second switching line are parallel to the first gate line.

In an embodiment, the first high pixel is in a first pixel column, and the first low pixel is in the first pixel column.

In an embodiment, the first high pixel is in a first pixel column, and the first low pixel is in a second pixel column adjacent to the first pixel column.

In an embodiment, in the display region further includes: a second low pixel connected to the first gate line and a third data line, the second low pixel being configured to represent a second low grayscale level; and a second high pixel connected to the first gate line and a fourth data line, the second high pixel being configured to represent a second high grayscale level.

In an embodiment, the selecting part includes: a third switch to connect the fourth data line to a second output part of the data driver in response to a first switching signal; and a fourth switch to connect the third data line to the second output part in response to a second switching signal.

In an embodiment, the first data line and the second data line are connected to the first output part, the third data line and the fourth data line are connected to a second output part of the data driver, and the first data line, the third data line, the second data line, and the fourth data line are sequentially arranged.

In an embodiment, the first data line and the second data line are connected to the first output part, the third data line and the fourth data line are connected to a second output part of the data driver, and the first data line, the second data line, the third data line, and the fourth data line are sequentially arranged.

In an embodiment, an operating frequency of the gate driver is different from an operating frequency of the data driver.

In an embodiment, the operating frequency of the data driver is twice the operating frequency of the gate driver.

In an embodiment, when a high duration of the gate signal is 1H, an applying duration of the data voltage is equal to or less than ½H.

According to an exemplary embodiment of the present invention, there is provided a method of driving a display apparatus, the method including: selectively connecting a first data line and a second data line to a first output part of a data driver utilizing a selecting part; displaying a first high grayscale level to a first high pixel connected to a first gate line and the first data line when the first data line is connected to the first output part; and displaying a first low grayscale level to a first low pixel connected to the first gate line and the second data line when the second data line is connected to the first output part.

In an embodiment, the selecting part includes: a first switch connecting the first data line to the first output part; and a second switch connecting the second data line to the first output part.

In an embodiment, the first switch is turned on in response to a high duration of a first switching signal, and the second switch is turned on in response to a high duration of a second switching signal, and when a high duration of a gate signal applied to the first gate line is 1H, the high duration of the first switching signal is equal to or less than ½H and the high duration of the second switching signal is equal to or less than ½H.

In an embodiment, an operating frequency of a gate driver configured to apply a gate signal to gate lines is different from an operating frequency of a data driver configured to apply a data voltage to data lines.

In an embodiment, the operating frequency of the data driver is twice the operating frequency of the gate driver.

In an embodiment, when a high duration of a gate signal applied to the first gate line is 1H, an applying duration of a data voltage to the first data line is equal to or less than ½H.

According to the display apparatus and the method of driving the display apparatus, two data lines are selectively connected to a single buffer so that the side visibility of the display panel may be efficiently improved (e.g., increased) without increasing the number of the channels of the data driver and the number of the data integrated circuits. In addition, the manufacturing cost of the display apparatus may be reduced.

BRIEF DESCRIPTION OF THE DRAWINGS

The above and other features and advantages of the present inventive concept will become more apparent by describing in detailed exemplary embodiments thereof with reference to the accompanying drawings, in which.

DETAILED DESCRIPTION

Figure 1:
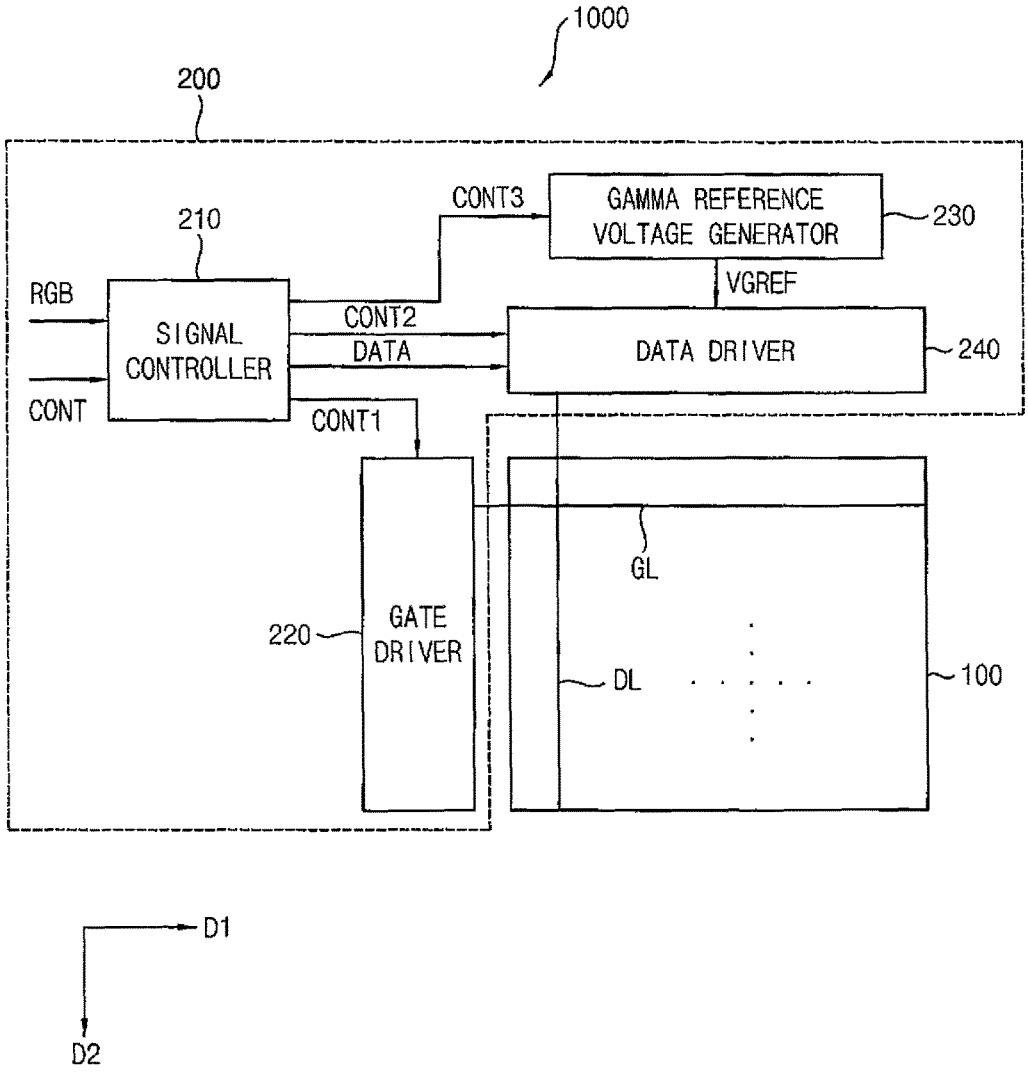
FIG. 1 is a block diagram illustrating a display apparatus according to an exemplary embodiment of the present inventive concept.

Hereinafter, the present inventive concept will be explained in detail with reference to the accompanying drawings.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the terms "use," "using," and "used" may be considered synonymous with the terms "utilize," "utilizing," and "utilized," respectively.

The display apparatus and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display apparatus may be formed on one integrated circuit (IC) chip or on separate IC chips. Further, the various components of the display apparatus may be implemented on a flexible printed circuit film, a tape carrier package (TCP), a printed circuit board (PCB), or formed on a same substrate. Further, the various components of the display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

FIG. 1 is a block diagram illustrating a display apparatus 1000 according to an exemplary embodiment of the present inventive concept.

Referring to FIG. 1, the display apparatus 1000 includes a display panel 100 and a panel driver 200. The panel driver 200 includes a signal controller 210, a gate driver 220, a gamma reference voltage generator 230, and a data driver 240. The display apparatus 1000 further include a selecting part selectively connect the adjacent data lines to the data driver 240. A structure and an operation of the selecting part are explained referring to FIGS. 2 and 3 in further detail.

The display panel 100 has a display region on which an image is displayed and a peripheral region adjacent to the display region.

The display panel 100 includes a plurality of gate lines GL, a plurality of data lines DL, and a plurality of pixels connected to the gate lines GL and the data lines DL. The gate lines extend in a first direction D1 and the data lines extend in a second direction D2 crossing the first direction D1.

Each pixel includes a high pixel and a low pixel. The pixels may be arranged in a matrix form. A pixel structure is explained referring to FIG. 2 in further detail.

The signal controller 210 receives input image data RGB and an input control signal CONT from an external apparatus. The input image data may include red image data R, green image data G, and blue image data B. The input control signal CONT may include a master clock signal and a data enable signal. The input control signal CONT may further include a vertical synchronizing signal and a horizontal synchronizing signal.

The signal controller 210 generates a first control signal CONT1, a second control signal CONT2, a third control signal CONT3, and a data signal DATA based on the input image data RGB and the input control signal CONT.

The signal controller 210 generates the first control signal CONT1 for controlling an operation of the gate driver 220 based on the input control signal CONT, and outputs the first control signal CONT1 to the gate driver 220. The first control signal CONT1 may further include a vertical start signal and a gate clock signal.

The signal controller 210 generates the second control signal CONT2 for controlling an operation of the data driver 240 based on the input control signal CONT, and outputs the second control signal CONT2 to the data driver 240. The second control signal CONT2 may include a horizontal start signal and a load signal.

The signal controller 210 generates the data signal DATA based on the input image data RGB. The signal controller 210 outputs the data signal DATA to the data driver 240.

The signal controller 210 may generate a high data signal having a high gamma based on the input image data RGB. The signal controller 210 may generate a low data signal having a low gamma based on the input image data RGB.

The signal controller 210 generates the third control signal CONT3 for controlling an operation of the gamma reference voltage generator 230 based on the input control signal CONT, and outputs the third control signal CONT3 to the gamma reference voltage generator 230.

The gate driver 220 generates gate signals driving the gate lines in response to the first control signal CONT1 received from the signal controller 210. The gate driver 220 sequentially outputs the gate signals to the gate lines.

The gate driver 220 may be directly mounted on the display panel 100, or may be connected to the display panel 100 with a tape carrier package ("TCP"). Alternatively, the gate driver 220 may be integrated with the display panel 100.

The gamma reference voltage generator 230 generates a gamma reference voltage VGREF in response to the third control signal CONT3 received from the signal controller 210. The gamma reference voltage generator 230 provides the gamma reference voltage VGREF to the data driver 240. The gamma reference voltage VGREF has a value corresponding to a level of the data signal DATA.

In an exemplary embodiment, the gamma reference voltage generator 230 may be located in the signal controller 210, or in the data driver 240. For example, the gamma reference voltage generator 230 may be integrally formed with the signal controller 210. For example, the gamma reference voltage generator 230 may be integrally formed with the data driver 240.

The data driver 240 receives the second control signal CONT2 and the data signal DATA from the signal controller 210, and receives the gamma reference voltages VGREF from the gamma reference voltage generator 230. The data driver 240 converts the data signal DATA into analog data voltages using the gamma reference voltages VGREF. The data signals DATA are converted into analog data voltages in the data driver 240. The converted data voltages are outputted to the data lines DL.

The data driver 240 may be directly mounted on the display panel 100, or be connected to the display panel 100 with a TCP. Alternatively, the data driver 240 may be integrated on the display panel 100.

Figure 2:
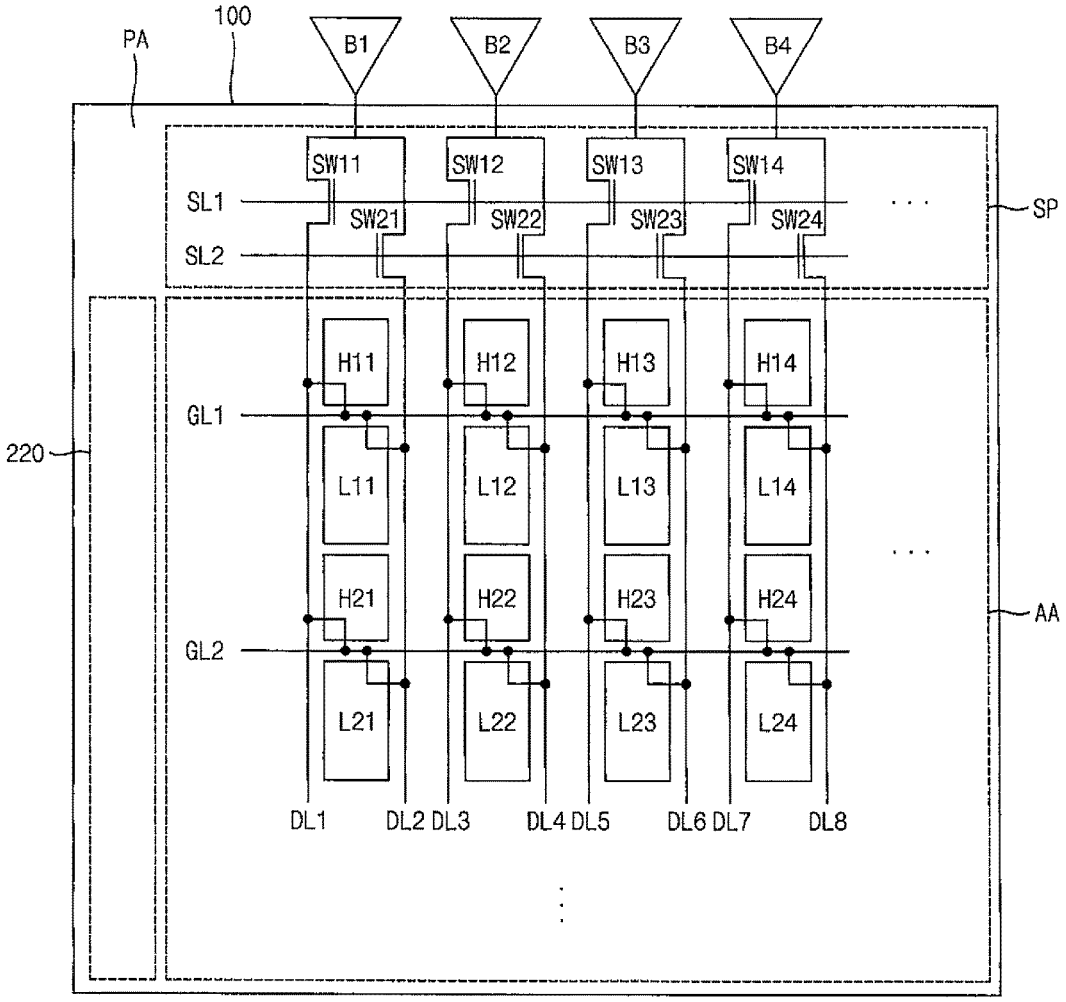
FIG. 2 is a conceptual diagram illustrating a gate driver, a buffer of a data driver, a selecting part, and a display panel of FIG. 1.
Figure 3:
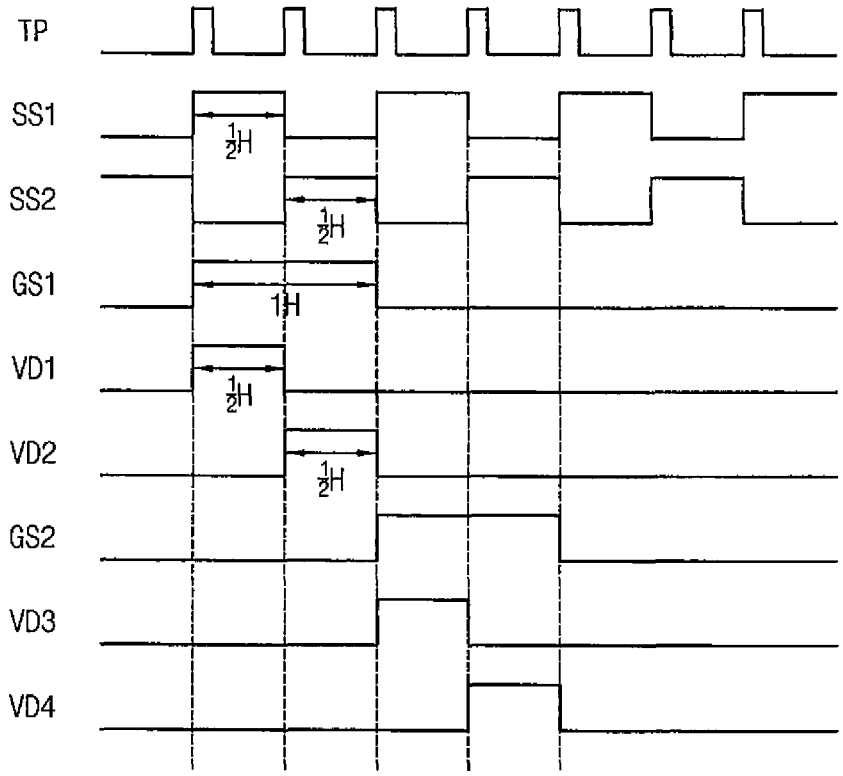
FIG. 3 is a timing diagram illustrating signals applied to a switching line, a gate line, and a data line of the display panel of FIG. 1.

FIG. 2 is a conceptual diagram illustrating the gate driver 220, the buffer B1, B2, B3, and B4 of the data driver 240, the selecting part SP and the display panel 100 of FIG. 1. FIG. 3 is a timing diagram illustrating signals applied to a switching line SL1 and SL2, the gate line and GL1 and GL2, and the data line DL1 to DL8 of the display panel 100 of FIG. 1.

Referring to FIGS. 1 to 3, the display panel 100 includes a plurality of pixels. The pixels are located in the display region AA of the display panel 100.

The pixel includes one of high pixels H11 to H24 and one of low pixels L11 to L24. Each of the high pixels H11 to H24 refer to subpixels representing a relatively high grayscale level for a specific grayscale, and each of the low pixels L11 to L24 refer to a subpixel representing a relatively low grayscale level for the specific grayscale. For example, a high grayscale level of a first high pixel H11 may have an absolute value greater than an absolute value of a low grayscale level of a first low pixel L11. The high grayscale level of the first high pixel H11 and the low grayscale level of the first low pixel L11 represent a grayscale of a first pixel H11 and L11 (i.e., a first pixel including the first high pixel H11 and the first low pixel L11).

For example, the display panel 100 includes the first high pixel H11, the first low pixel L11, a second high pixel H12, and a second low pixel L12. The first high pixel H11 is connected to a first gate line GL1 and a first data line DL1, and represents a first high grayscale level. The first low pixel L11 is connected to the first gate line GL1 and a second data line DL2, and represents a first low grayscale level. The first high grayscale level and the first low grayscale level represent the grayscale of the first pixel H11 and L11. The second high pixel H12 is connected to the first gate line GL1 and a third data line DL3, and represents a second high grayscale level. The second low pixel L12 is connected to the first gate line GL1 and a fourth data line DL4, and represents a second low grayscale level. The second high grayscale level and the second low grayscale level represent the grayscale of a second pixel H12 and L12 (i.e., a first pixel including the second high pixel H12 and the second low pixel L12).

The display panel 100 further includes a third high pixel H21, a third low pixel L21, a fourth high pixel H22, and a fourth low pixel L22. The third high pixel H21 is connected to a second gate line GL2 and the first data line DL1, and represents a third high grayscale level. The third low pixel L21 is connected to the second gate line GL2 and the second data line DL2, and represents a third low grayscale level. The third high grayscale level and the third low grayscale level represent the grayscale of a third pixel H21 and L21. The display panel 100 includes a fourth high pixel H22 connected to the second gate line GL2 and the third data line DL3 and representing a fourth high grayscale and a fourth low pixel L22 connected to the second gate line GL2 and the fourth data line DL4 and representing a fourth low grayscale. The fourth high grayscale and the fourth low grayscale represent the grayscale of a fourth pixel H22 and L22.

In the present exemplary embodiment, the first high pixel H11, the first low pixel L11, the third high pixel H21, and the third low pixel L21 are located in a first pixel column. The second high pixel H12, the second low pixel L12, the fourth high pixel H22, and the fourth low pixel L22 are located in a second pixel column adjacent to the first pixel column.

Although a connecting structure of the pixels in a two by two matrix is explained for convenience of explanation, the above pixel structure in the two by two matrix may be repetitive in a horizontal direction and in a vertical direction.

The selecting part SP may include a first switch SW11 for connecting the first data line DL1 to a first buffer B1 of the data driver 240 in response to a first switching signal SS1, and a second switch SW21 for connecting the second data line DL2 to the first buffer B1 in response to a second switching signal SS2.

For example, the first switch SW11 may be connected to the first buffer B1 through a first output part of the data driver 240. For example, the second switch SW21 may be connected to the first buffer B1 through the first output part of the data driver 240. The first output part may be a first pad of a driving chip of the data driver 240.

The first switching signal SS1 and the second switching signal SS2 may be generated in the signal controller 210 and transmitted to the selecting part SP.

The selecting part SP may further include a third switch SW12 for connecting the third data line DL3 to a second buffer B2 of the data driver 240 in response to the first switching signal SS1, and a fourth switch SW22 for connecting the fourth data line DL4 to the second buffer B2 in response to the second switching signal SS2.

For example, the third switch SW12 may be connected to the second buffer B2 through a second output part of the data driver 240. For example, the fourth switch SW22 may be connected to the second buffer B2 through the second output part of the data driver 240. The second output part may be a second pad of the driving chip of the data driver 240.

In the present exemplary embodiment, the selecting part SP may be located on the display panel 100. The selecting part SP may be located in the peripheral region PA of the display panel 100. For example, the switches SW11, SW12, SW13, SW14, SW21, SW22, SW23, and SW24 are integrated with a substrate of the display panel 100. Alternatively, the selecting part SP may be formed in the data driver 240.

The selecting part SP may further include a first switching line SL1 for applying the first switching signal to the first switch SW11 and a second switching line SL2 for applying the second switching signal to the second switch SW21.

In the present exemplary embodiment, the first switching line SL1 may be connected to the third switch SW12. The second switching line SL2 may be connected to the fourth switch SW22.

For example, the first switching line SL1 and the second switching line SL2 may be parallel to the gate lines GL1 and GL2.

Although the selecting part SP includes the switches SW11, SW12, SW13, SW14, SW21, SW22, SW23, and SW24 in the present exemplary embodiment, the present inventive concept is not limited to the structure of the selecting part SP. Alternatively, the selecting part SP may include a demultiplexer (demux).

In FIG. 3, when the first gate signal GS1 has a high level, the switching elements of the subpixels H11, H12, H13, H14, L11, L12, L13, and L14 connected to the first gate line GL1 are turned on. Herein, a high duration refers to a period of time when the gate signal has a high level.

The high duration of the first gate signal GS1 may be 1H (one horizontal cycle). In an early part of the first horizontal cycle when the first gate signal GS1 has the high duration, the first switching signal SS1 has a high duration. In a late part of the first horizontal cycle, the second switching signal SS2 has a high duration.

During the high duration of the first switching signal SS1, the first buffer B1 is connected to the first data line DL1 through the first switch SW11, and the first high grayscale level corresponding to the first data line DL1 among levels of a first data voltage VD1 is applied to the first high pixel H11.

During the high duration of the first switching signal SS1, the second buffer B2 is connected to the third data line DL3 through the third switch SW12, and the second high grayscale level corresponding to the third data line DL3 among the levels of the first data voltage VD1 is applied to the second high pixel H12.

During the high duration of the second switching signal SS2, the first buffer B1 is connected to the second data line DL2 through the second switch SW21, and the first low grayscale level corresponding to the second data line DL2 among levels of a second data voltage VD2 is applied to the first low pixel L11.

During the high duration of the second switching signal SS2, the second buffer B2 is connected to the fourth data line DL4 through the fourth switch SW22, and the second low grayscale level corresponding to the fourth data line DL4 among the levels of the second data voltage VD2 is applied to the second low pixel L12.

The high duration of the second gate signal GS2 may be 1H (one horizontal cycle). In an early part of the second horizontal cycle when the second gate signal GS2 has the high duration, the first switching signal SS1 has a high duration. In a late part of the second horizontal cycle, the second switching signal SS2 has a high duration.

During the high duration of the first switching signal SS1, the first buffer B1 is connected to the first data line DL1 through the first switch SW11, and the third high grayscale level corresponding to the first data line DL1 among levels of a third data voltage VD3 is applied to the third high pixel H21.

During the high duration of the first switching signal SS1, the second buffer B2 is connected to the third data line DL3 through the third switch SW12, and the fourth high grayscale level corresponding to the third data line DL3 among the levels of the third data voltage VD3 is applied to the fourth high pixel H22.

During the high duration of the second switching signal SS2, the first buffer B1 is connected to the second data line DL2 through the second switch SW21, and the third low grayscale level corresponding to the second data line DL2 among levels of a fourth data voltage VD4 is applied to the third low pixel L21.

During the high duration of the second switching signal SS2, the second buffer B2 is connected to the fourth data line DL4 through the fourth switch SW22, and the fourth low grayscale level corresponding to the fourth data line DL4 among the levels of the fourth data voltage VD4 is applied to the fourth low pixel L22.

For example, when the high duration of the gate signal is 1H, the high duration of the first switching signal may be equal to or less than ½H and the high duration of the second switching signal may be equal to or less than ½H.

An operating frequency of the gate driver 220 may be different from an operating frequency of the data driver 240.

For example, the operating frequency of the data driver 240 may be twice that of the operating frequency of the gate driver 220. For example, the operating frequency of the data driver 240 may be about 240 Hz and the operating frequency of the gate driver 220 may be about 120 Hz. In another example, the operating frequency of the data driver 240 may be about 120 Hz and the operating frequency of the gate driver 220 may be about 60 Hz.

The operating frequency of the gate driver 220 may be determined by the number of rising edges of the gate signals GS1 and GS2. The operating frequency of the data driver 240 may be determined by the number of rising edges of the load signal TP for outputting data voltages VD1, VD2, VD3, and VD4. At the rising edges of the load signal TP, the first data voltage VD1, the second data voltage VD2, the third data voltage VD3, and the fourth data voltage VD4 may be respectively and sequentially outputted. In the present exemplary embodiment, when the gate signal GS1 and GS2 rises once, the load signal TP rises twice.

For example, when the high duration of the gate signal GS1 and GS2 is 1H, an applying duration of the data voltage VD1, VD2, VD3, and VD4 may be equal to or less than ½H.

In the present exemplary embodiment, the first data line DL1, the second data line DL2, the third data line DL3, and the fourth data line DL4 may be sequentially arranged.

In the present exemplary embodiment, the gate driver 220 may be located in the peripheral region PA of the display panel 100. The gate driver 220 may be integrated on the display panel 100. The gate driver 220 is integrated on a glass substrate, generates the gate signal, and outputs the gate signal to the gate lines GL.

According to the present exemplary embodiment, the buffer B1 and B2 of the data driver 240 is alternately connected to two data lines by the selecting part SP. Thus, the side visibility of the display panel 100 may be efficiently improved (e.g., increased) without increasing the number of the channels and the buffers of the data driver 240. In addition, the manufacturing cost of the display apparatus 1000 may be reduced.

Figure 4A:
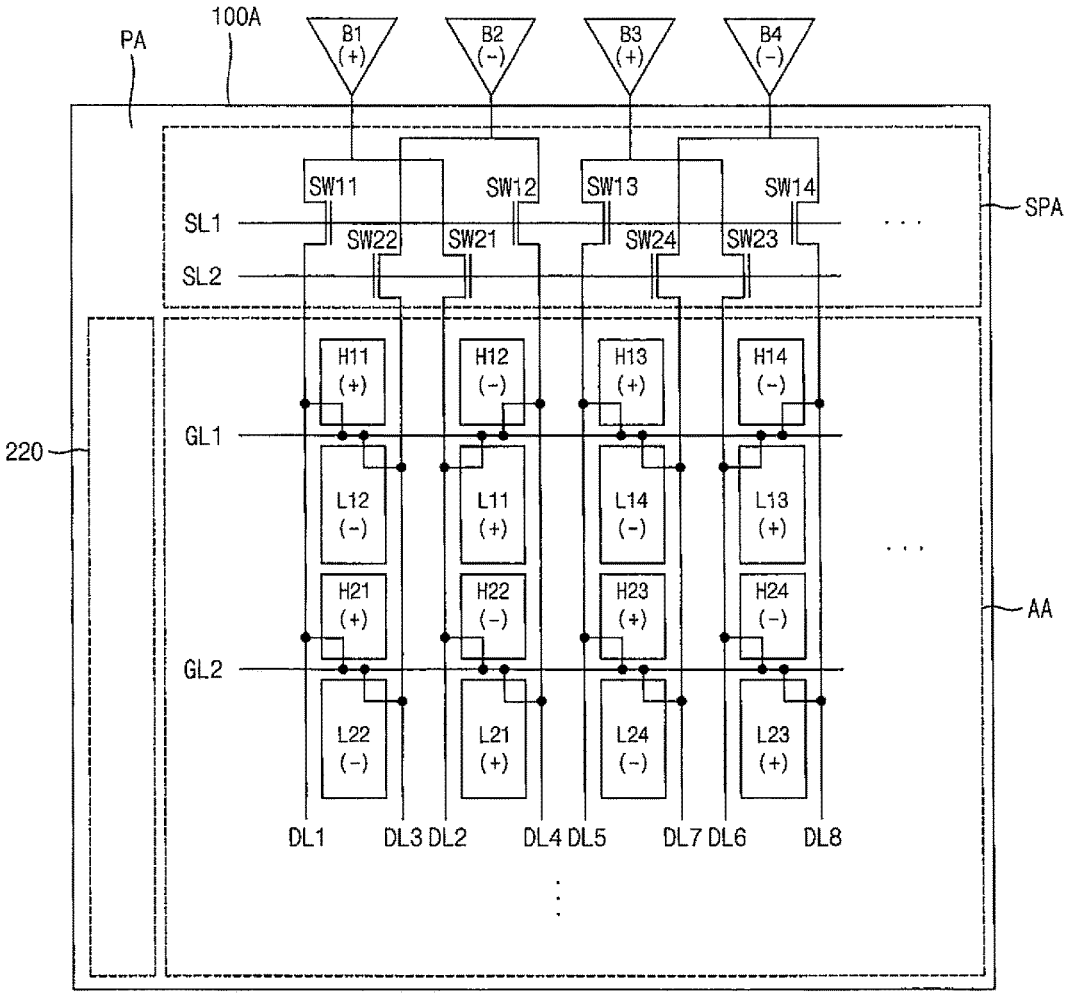
FIGS. 4A and 4B are plan views illustrating the gate driver, the buffer of the data driver, the selecting part, and the display panel according to an exemplary embodiment of the present inventive concept.
Figure 4B:
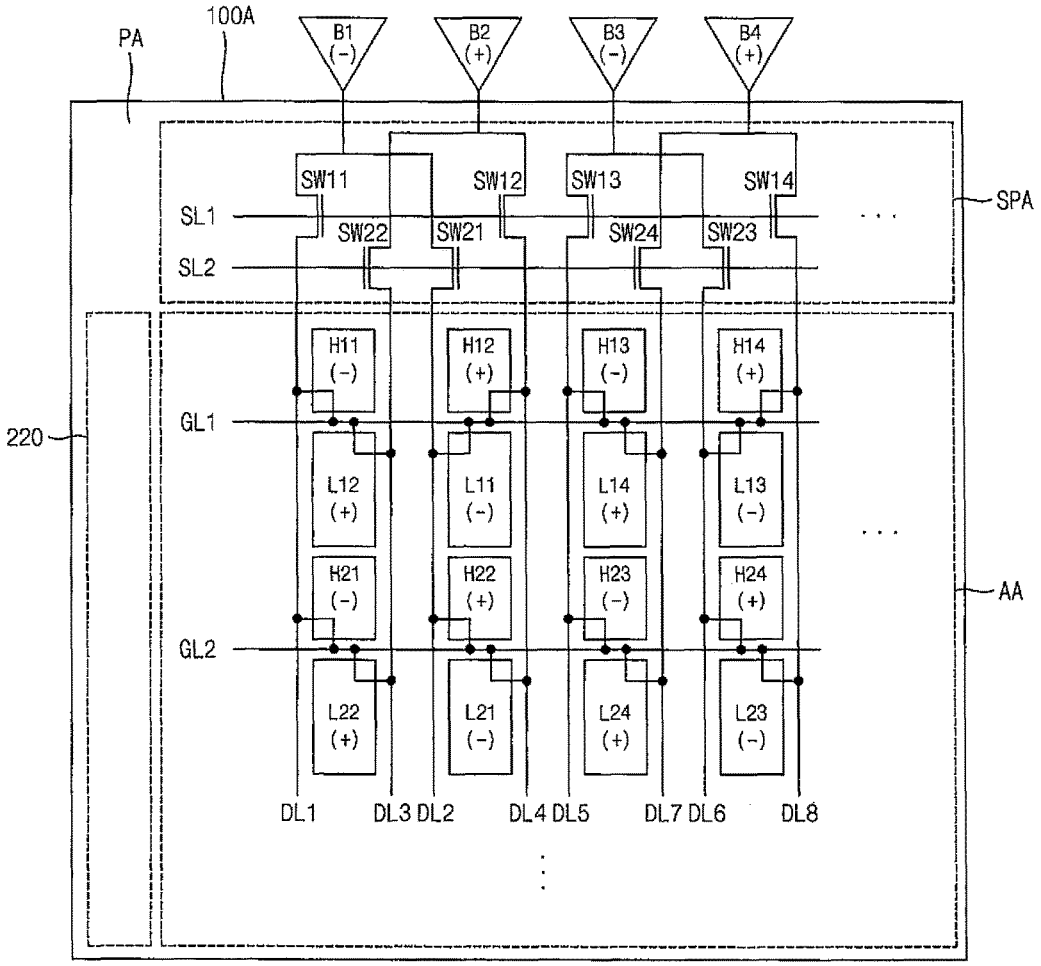

FIGS. 4A and 4B are plan views illustrating the gate driver, the buffer of the data driver, the selecting part, and the display panel according to an exemplary embodiment of the present inventive concept.

The display apparatus according to the present exemplary embodiment is substantially the same as the display apparatus of the previous exemplary embodiment explained referring to FIGS. 1 to 3 except for the selecting part and the pixel structure of the display panel. Thus, the same reference numerals will be used to refer to the same or like parts as those described in the previous exemplary embodiment of FIGS. 1 to 3 and any repetitive explanation concerning the above elements may not be provided.

Referring to FIGS. 1, 3, 4A, and 4B, in the present exemplary embodiment, a dot inversion method is applied to a pixel structure including a pixel having a high pixel and a low pixel to improve side visibility.

The display panel 100A includes a plurality of pixels. The pixel includes a high pixel and a low pixel. The pixels are located in the display region AA of the display panel 100A.

For example, the display panel 100A includes the first high pixel H11 and the first low pixel L11. The first high pixel H11 is connected to a first gate line GL1 and a first data line DL1, and represents a first high grayscale level. The first low pixel L11 is connected to the first gate line GL1 and a second data line DL2, and representing a first low grayscale level. The display panel 100A may further include a second high pixel H12 and a fourth data line DL4. The second high pixel H12 is connected to the first gate line GL1 and a third data line DL3, and represents a second high grayscale level. The second low pixel L12 is connected to the first gate line GL1 and a fourth data line DL4, and represents a second low grayscale level. In the present exemplary embodiment, the first high pixel H11 and the second low pixel L12 form a pixel (a first pixel). Thus, the first high grayscale level and the second low grayscale level represent the grayscale of the first pixel H11 and L12. The second high pixel H12 and the first low pixel L11 form a pixel (a second pixel). Thus, the second high grayscale level and the first low grayscale level represent the grayscale of the second pixel H12 and L11.

The display panel 100A may further include a third high pixel H21 and a third low pixel L21. The third high pixel H21 is connected to a second gate line GL2 and the first data line DL1, and represents a third high grayscale level. The third low pixel L21 is connected to the second gate line GL2 and the second data line DL2, and represents a third low grayscale level. The display panel 100A may further include a fourth high pixel H22 and a fourth low pixel L22. The fourth high pixel H22 is connected to the second gate line GL2 and the third data line DL3, and represents a fourth high grayscale level. The fourth low pixel L22 is connected to the second gate line GL2 and the fourth data line DL4, and represents a fourth low grayscale level. In the present exemplary embodiment, the third high pixel H21 and the fourth low pixel L22 form a pixel (a third pixel). Thus, the third high grayscale level and the fourth low grayscale level represent the grayscale of the third pixel H21 and L22. The fourth high pixel H22 and the third low pixel L21 form a pixel (a fourth pixel). Thus, the fourth high grayscale level and the third low grayscale level represent the grayscale of the fourth pixel H22 and L21.

In the present exemplary embodiment, the first high pixel H11, the second low pixel L12, the third high pixel H21, and the fourth low pixel L22 are located in a first pixel column. The second high pixel H12, the first low pixel L11, the fourth high pixel H22, and the third low pixel L21 are located in a second pixel column adjacent to the first pixel column.

Although a connecting structure of the pixels in a two by two matrix is explained for convenience of explanation, the above pixel structure in the two by two matrix may be repetitive in a horizontal direction and in a vertical direction.

The selecting part SPA may include a first switch SW11 for connecting the first data line DL1 to a first buffer B1 of the data driver 240 in response to a first switching signal SS1 and a second switch SW21 for connecting the second data line DL2 to the first buffer B1 in response to a second switching signal SS2.

The selecting part SPA may further include a third switch SW12 for connecting the third data line DL3 to a second buffer B2 of the data driver 240 in response to the first switching signal SS1 and a fourth switch SW22 for connecting the fourth data line DL4 to the second buffer B2 in response to the second switching signal SS2.

In FIG. 3, when the first gate signal GS1 has the high duration, the switching elements of the subpixels H11, H12, H13, H14, L11, L12, L13, and L14 connected to the first gate line GL1 are turned on.

The high duration of the first gate signal GS1 may be 1H (one horizontal cycle). In an early part of the first horizontal cycle when the first gate signal GS1 has the high duration, the first switching signal SS1 has a high duration. In a late part of the first horizontal cycle, the second switching signal SS2 has a high duration.

During the high duration of the first switching signal SS1, the first buffer B1 is connected to the first data line DL1 through the first switch SW11, and the first high grayscale level corresponding to the first data line DL1 among levels of a first data voltage VD1 is applied to the first high pixel H11.

During the high duration of the first switching signal SS1, the second buffer B2 is connected to the fourth data line DL4 through the third switch SW12, and the second high grayscale level corresponding to the fourth data line DL4 among the levels of the first data voltage VD1 is applied to the second high pixel H12.

During the high duration of the second switching signal SS2, the first buffer B1 is connected to the second data line DL2 through the second switch SW21, and the first low grayscale level corresponding to the second data line DL2 among levels of a second data voltage VD2 is applied to the first low pixel L11.

During the high duration of the second switching signal SS2, the second buffer B2 is connected to the third data line DL3 through the fourth switch SW22, and the second low grayscale level corresponding to the third data line DL3 among the levels of the second data voltage VD2 is applied to the second low pixel L12.

The high duration of the second gate signal GS2 may be 1H (one horizontal cycle). In an early part of the second horizontal cycle when the second gate signal GS2 has the high duration, the first switching signal SS1 has a high duration. In a late part of the second horizontal cycle, the second switching signal SS2 has a high duration.

In the present exemplary embodiment, the second data line DL2 connected to the first buffer B1 and the third data line DL3 connected to the second buffer B2 cross each other. Thus, in the present exemplary embodiment, the first data line DL1, the third data line DL3, the second data line DL2, and the fourth data line DL4 may be sequentially arranged.

FIG. 4A represents the polarities of the pixels of the display panel 100A during a first frame and FIG. 4B represents the polarities of the pixels of the display panel 100A during a second frame.

In FIG. 4A, the first buffer B1 and a third buffer B3 output the data voltage of a positive polarity (+). Thus, the subpixels connected to the first buffer B1 and the third buffer B3 display the data voltage of the positive polarity (+). In FIG. 4A, the second buffer B2 and a fourth buffer B4 output the data voltage of a negative polarity (−). Thus, the subpixels connected to the second buffer B2 and the fourth buffer B4 display the data voltage of the negative polarity (−). Therefore, the display panel 100A has a dot inversion structure in a row direction and in a column direction.

In FIG. 4B, the polarities of the pixels of the display panel 100A are inverted. In FIG. 4B, the first buffer B1 and the third buffer B3 output the data voltage of the negative polarity (−). Thus, the subpixels connected to the first buffer B1 and the third buffer B3 display the data voltage of the negative polarity (−). In FIG. 4B, the second buffer B2 and the fourth buffer B4 output the data voltage of the positive polarity (+). Thus, the subpixels connected to the second buffer B2 and the fourth buffer B4 display the data voltage of the positive polarity (+).

According to the present exemplary embodiment, the buffer B1 and B2 of the data driver 240 is alternately connected to two data lines by the selecting part SPA. Thus, the side visibility of the display panel 100A may be efficiently improved (e.g., increased) without increasing the number of the channels and the buffers of the data driver 240. In addition, the manufacturing cost of the display apparatus 1000 may be reduced. In addition, the display quality of the display panel 100A may be further improved by the dot inversion driving method.

Figure 5A:
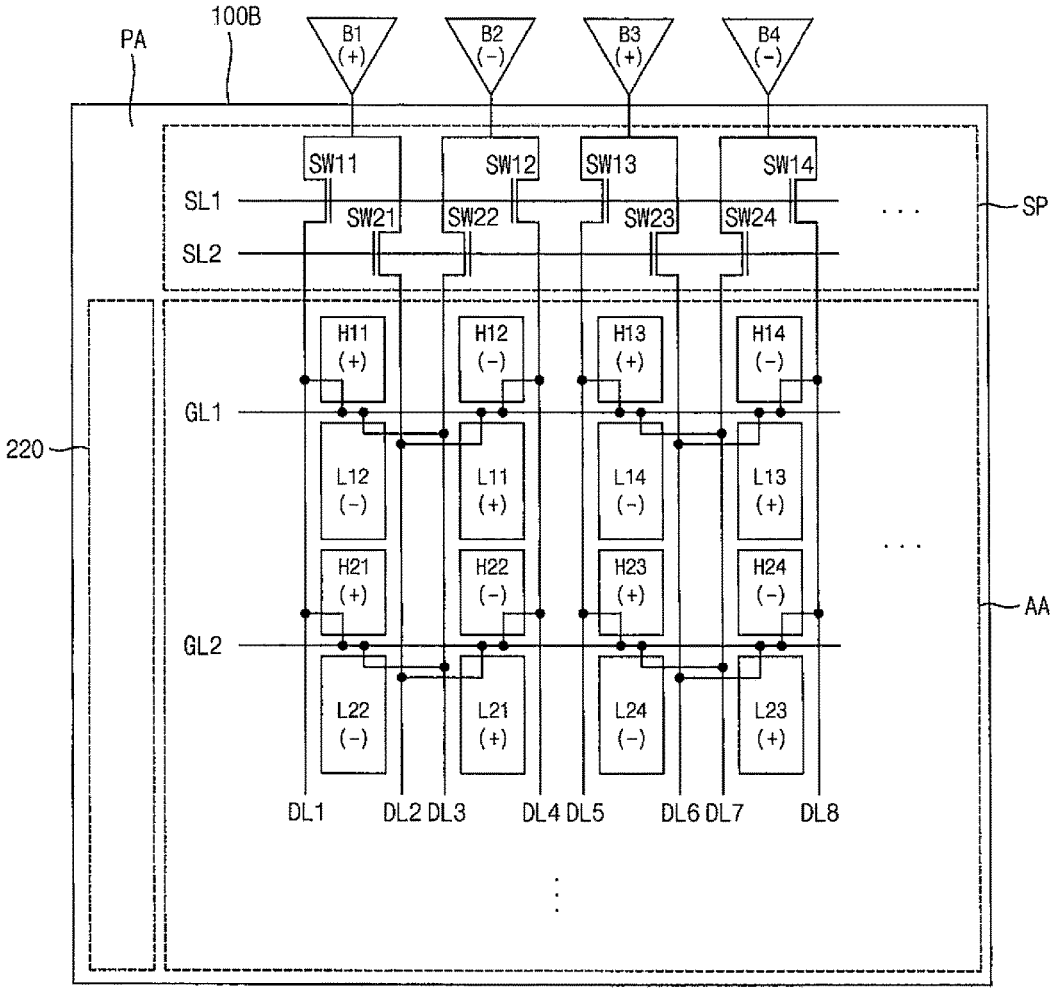
FIGS. 5A and 5B are plan views illustrating the gate driver, the buffer of the data driver, the selecting part, and the display panel according to an exemplary embodiment of the present inventive concept.
Figure 5B:
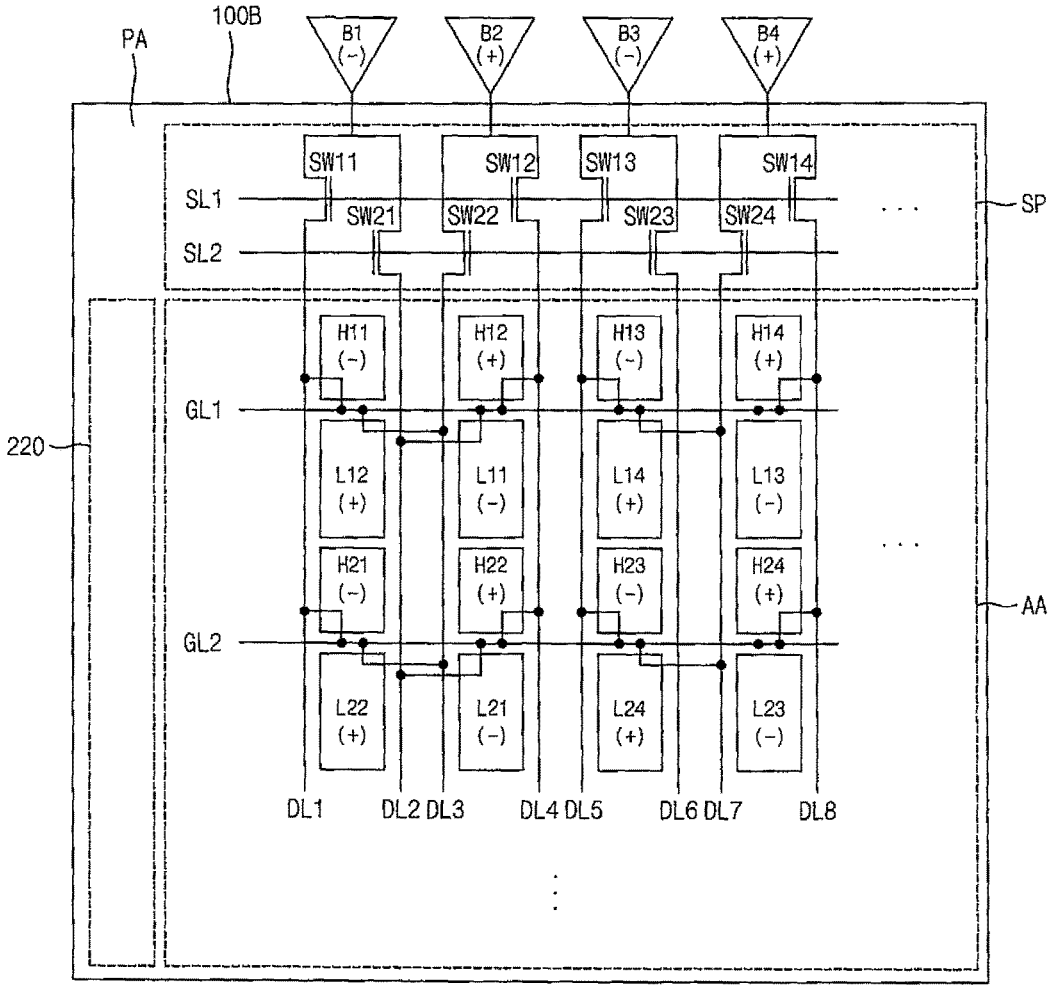

FIGS. 5A and 5B are plan views illustrating the gate driver 220, the buffer of the data driver 240, the selecting part SP and the display panel 100B according to an exemplary embodiment of the present inventive concept.

The display apparatus according to the present exemplary embodiment is substantially the same as the display apparatus of the previous exemplary embodiment explained referring to FIGS. 4A to 4B except for the selecting part and the pixel structure of the display panel. Thus, the same reference numerals will be used to refer to the same or like parts as those described in the previous exemplary embodiment of FIGS. 4A to 4B and any repetitive explanation concerning the above elements may not be provided.

Referring to FIGS. 1, 3, 5A, and 5B, in the present exemplary embodiment, a dot inversion method is applied to a pixel structure including a pixel having a high pixel and a low pixel to improve side visibility.

The display panel 100B includes a plurality of pixels. The pixel includes a high pixel and a low pixel. The pixels are located in the display region AA of the display panel 100B.

For example, the display panel 100B includes the first high pixel H11 and the first low pixel L11. The first high pixel H11 is connected to a first gate line GL1 and a first data line DL1, and represents a first high grayscale level. The first low pixel L11 is connected to the first gate line GL1 and a second data line DL2, and represents a first low grayscale level. The display panel 100B may further include a second high pixel H12 and a second low pixel L12. The second high pixel H12 is connected to the first gate line GL1 and a third data line DL3, and represents a second high grayscale level. The second low pixel L12 is connected to the first gate line GL1 and a fourth data line DL4, and represents a second low grayscale level.

The display panel 100B may further include a third high pixel H21 and a third low pixel L21. The third high pixel H21 is connected to a second gate line GL2 and the first data line DL1, and represents a third high grayscale level. The third low pixel L21 is connected to the second gate line GL2 and the second data line DL2, and represents a third low grayscale level. The display panel 100B may further include a fourth high pixel H22 and a fourth low pixel L22. The fourth high pixel H22 is connected to the second gate line GL2 and the third data line DL3, and represents a fourth high grayscale level. The fourth low pixel L22 is connected to the second gate line GL2 and the fourth data line DL4, and represents a fourth low grayscale level.

In the present exemplary embodiment, the first high pixel H11, the second low pixel L12, the third high pixel H21, and the fourth low pixel L22 are located in a first pixel column. The second high pixel H12, the first low pixel L11, the fourth high pixel H22, and the third low pixel L21 are located in a second pixel column adjacent to the first pixel column.

Although a connecting structure of the pixels in a two by two matrix is explained for convenience of explanation, the above pixel structure in the two by two matrix may be repetitive in a horizontal direction and in a vertical direction.

The selecting part SP may include a first switch SW11 for connecting the first data line DL1 to a first buffer B1 of the data driver 240 in response to a first switching signal SS1, and a second switch SW21 for connecting the second data line DL2 to the first buffer B1 in response to a second switching signal SS2.

The selecting part SP may further include a third switch SW12 for connecting the third data line DL3 to a second buffer B2 of the data driver 240 in response to the first switching signal SS1, and a fourth switch SW22 for connecting the fourth data line DL4 to the second buffer B2 in response to the second switching signal SS2.

In the present exemplary embodiment, the second data line DL2 connected to the first buffer B1 and the third data line DL3 connected to the second buffer B2 do not cross each other. Instead, the first low pixel L11 in the second pixel column is connected to the second data line DL2. A connecting line between the first low pixel L11 and the second data line DL2 crosses the third data line DL3. The second low pixel L12 in the first pixel column is connected to the third data line DL3. A connecting line between the second low pixel L12 and the third data line DL3 crosses the second data line DL2.

Thus, in the present exemplary embodiment, the first data line DL1, the second data line DL2, the third data line DL3, and the fourth data line DL4 may be sequentially arranged.

To connect the first low pixel L11 to the third data line DL3 without connecting to the second data line DL2, the display panel 100B may include a contact hole (e.g., a contact opening). To connect the second low pixel L12 to the second data line DL2 without connecting to the third data line DL3, the display panel 100B may further include a contact hole (e.g., a contact opening).

FIG. 5A represents the polarities of the pixels of the display panel 100B during a first frame, and FIG. 5B represents the polarities of the pixels of the display panel 100B during a second frame.

In FIG. 5A, the first buffer B1 and a third buffer B3 output the data voltage of a positive polarity (+). Thus, the subpixels connected to the first buffer B1 and the third buffer B3 display the data voltage of the positive polarity (+). In FIG. 5A, the second buffer B2 and a fourth buffer B4 output the data voltage of a negative polarity (−). Thus, the subpixels connected to the second buffer B2 and the fourth buffer B4 display the data voltage of the negative polarity (−). Therefore, the display panel 100B has a dot inversion structure in a row direction and in a column direction.

In FIG. 5B, the polarities of the pixels of the display panel 100B are inverted. In FIG. 5B, the first buffer B1 and the third buffer B3 output the data voltage of the negative polarity (−). Thus, the subpixels connected to the first buffer B1 and the third buffer B3 display the data voltage of the negative polarity (−). In FIG. 5B, the second buffer B2 and the fourth buffer B4 output the data voltage of the positive polarity (+). Thus, the subpixels connected to the second buffer B2 and the fourth buffer B4 display the data voltage of the positive polarity (+).

According to the present exemplary embodiment, the buffer B1 and B2 of the data driver 240 is alternately connected to two data lines by the selecting part SP. Thus, the side visibility of the display panel 100B may be efficiently improved (e.g., increased) without increasing the number of the channels and the buffers of the data driver 240. In addition, the manufacturing cost of the display apparatus 1000 may be reduced. In addition, the display quality of the display panel 100B may be further improved by the dot inversion driving method.

According to the present inventive concept as explained above, the side visibility of the display panel may be improved (e.g., increased) so that the display quality of the display apparatus may be improved. In addition, the manufacturing cost of the display apparatus may be reduced.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A display apparatus comprising:

a display region comprising a first high pixel connected to a first gate line and a first data line, and a first low pixel connected to the first gate line and a second data line, the first high pixel being configured to represent a first high grayscale level, the first low pixel being configured to represent a first low grayscale level;

a gate driver configured to apply a gate signal to the gate line;

a data driver comprising a first output part configured to apply a data voltage to the first data line and the second data line; and a selecting part comprising a first switch to connect only the first data line of the first and second data lines and only the first high pixel of the first high pixel and the first low pixel to the first output part and a second switch to connect only the second data line of the first and second data lines and only the first low pixel of the first low pixel and the first high pixel to the first output part, the selecting part configured to alternately connect the first data line and the second data line to the first output part of the data driver with the first and second switches, such that only one of the first and second data lines and only one of the first high pixel and the first low pixel is connected to the first output part at any given time, wherein the first high pixel is connected only to the first data line of the first and second data lines, wherein the first low pixel is connected only to the second data line of the first and second data lines, wherein the first high grayscale level has an absolute value greater than an absolute value of the first low grayscale level for a same target grayscale, and wherein the first switch is along the first data line and the second switch is along the second data line.

2. The display apparatus of claim 1, wherein the first switch is turned on in response to a high duration of a first switching signal, the second switch is turned on in response to a high duration of a second switching signal, and wherein when a high duration of the gate signal is 1H, the high duration of the first switching signal is equal to or less than ½H and the high duration of the second switching signal is equal to or less than ½H.

3. The display apparatus of claim 2, wherein the selecting part is between the data driver and the display region.

4. The display apparatus of claim 3, wherein the selecting part is on a peripheral region, the peripheral region being for not displaying an image in a display panel.

5. The display apparatus of claim 3, wherein the selecting part further comprises:

a first switching line configured to apply the first switching signal to the first switch; and a second switching line configured to apply the second switching signal to the second switch, wherein the first switching line and the second switching line are parallel to the first gate line.

6. The display apparatus of claim 1, wherein the first high pixel is in a first pixel column, and wherein the first low pixel is in the first pixel column.

7. The display apparatus of claim 1, wherein the first high pixel is in a first pixel column, and wherein the first low pixel is in a second pixel column adjacent to the first pixel column.

8. The display apparatus of claim 7, wherein the display region further comprises:

a second low pixel connected to the first gate line and a third data line, the second low pixel being configured to represent a second low grayscale level; and a second high pixel connected to the first gate line and a fourth data line, the second high pixel being configured to represent a second high grayscale level.

9. The display apparatus of claim 8, wherein the selecting part comprises:

a third switch to connect the fourth data line to a second output part of the data driver in response to a first switching signal; and a fourth switch to connect the third data line to the second output part in response to a second switching signal.

10. The display apparatus of claim 8, wherein the first data line and the second data line are connected to the first output part, wherein the third data line and the fourth data line are connected to a second output part of the data driver, and wherein the first data line, the third data line, the second data line, and the fourth data line are sequentially arranged.

11. The display apparatus of claim 8, wherein the first data line and the second data line are connected to the first output part, wherein the third data line and the fourth data line are connected to a second output part of the data driver, and wherein the first data line, the second data line, the third data line, and the fourth data line are sequentially arranged.

12. The display apparatus of claim 1, wherein an operating frequency of the gate driver is different from an operating frequency of the data driver.

13. The display apparatus of claim 12, wherein the operating frequency of the data driver is twice the operating frequency of the gate driver.

14. The display apparatus of claim 1, wherein when a high duration of the gate signal is 1H, an applying duration of the data voltage is equal to or less than ½H.

15. A method of driving a display apparatus, the method comprising:

selectively connecting a first data line and a second data line to a first output part of a data driver utilizing a selecting part;

displaying a first high grayscale level to a first high pixel connected to a first gate line and the first data line when the first data line is connected to the first output part; and displaying a first low grayscale level to a first low pixel connected to the first gate line and the second data line when the second data line is connected to the first output part, wherein the first high pixel is connected only to the first data line of the first and second data lines, wherein the first low pixel is connected only to the second data line of the first and second data lines, wherein the first high grayscale level has an absolute value greater than an absolute value of the first low grayscale level for a same target grayscale, wherein the selecting part comprises a first switch to connect only the first data line of the first and second data lines and only the first high pixel of the first high pixel and the first low pixel to the first output part and a second switch to connect only the second data line of the first and second data lines and only the first low pixel of the first low pixel and the first high pixel to the first output part, the selecting part configured to alternately connect the first data line and the second data line to the first output part of the data driver with the first and second switches, such that only one of the first and second data lines and only one of the first high pixel and the first low pixel is connected to the first output part at any given time, and wherein the first switch is along the first data line and the second switch is along the second data line.

16. The method of claim 15, wherein the first switch is turned on in response to a high duration of a first switching signal, and the second switch is turned on in response to a high duration of a second switching signal, and wherein when a high duration of a gate signal applied to the first gate line is 1H, the high duration of the first switching signal is equal to or less than ½H and the high duration of the second switching signal is equal to or less than ½H.

17. The method of claim 15, wherein an operating frequency of a gate driver configured to apply a gate signal to the first gate line is different from an operating frequency of the data driver configured to apply the data voltage to the first and second data lines.

18. The method of claim 17, wherein the operating frequency of the data driver is twice the operating frequency of the gate driver.

19. The method of claim 15, wherein when a high duration of a gate signal applied to the first gate line is 1H, an applying duration of the data voltage applied to the first data line is equal to or less than ½H.

* * * * *